United States Patent [19]

Nonini

[11] Patent Number: 4,872,330

[45] Date of Patent: Oct. 10, 1989

[54] PLANT FOR STRAIGHTENING AND CUTTING TO LENGTH ROLLED SECTIONS OR BARS

[75] Inventor: Geremia Nonini, Buttrio, Italy

[73] Assignee: Danieli & C. Officine Meccaniche SpA, Buttrio, Italy

[21] Appl. No.: 156,824

[22] Filed: Feb. 17, 1988

[30] Foreign Application Priority Data

Feb. 24, 1987 [IT] Italy ..... 83321 A/87

[51] Int. Cl.[4] ..... B21B 15/00

[52] U.S. Cl. ..... 72/131; 72/203

[58] Field of Search ..... 72/129, 131, 160, 203, 72/250, 251

[56] References Cited

U.S. PATENT DOCUMENTS 1,424,465 8/1922 Gail ..... 72/203 X
3,135,143 6/1964 Neumann ..... 72/203
4,397,169 8/1983 Staat ..... 72/203 X

FOREIGN PATENT DOCUMENTS 0067391 12/1982 European Pat. Off. .
0201120 11/1986 European Pat. Off. .
1217747 10/1961 Fed. Rep. of Germany .

*Primary Examiner*—E. Michael Combs
*Attorney, Agent, or Firm*—Wegner & Bretschneider

[57] ABSTRACT

Plant for cutting to size rolled sections such as angle irons, channel sections, T-bars, window profiles, trackways for lifts or elevators and the like, and also rolled bars such as round and flat bars and the like, comprising a cooling plate (19), a feed line (10) on which the rolled sections or bars are loaded, a straightening machine (11) for straightening said rolled sections or bars and a shears (13) for cutting to size said rolled bars while they are moving, it further comprising a disk saw (16) for cutting to size said rolling sections.

3 Claims, 1 Drawing Sheet

PLANT FOR STRAIGHTENING AND CUTTING TO LENGTH ROLLED SECTIONS OR BARS

BACKGROUND OF THE INVENTION

This invention concerns a plant for multistrand straightening and cutting to length of rolled sections or bars. The plant concerns in particular the cutting to size of rolled section, such as angle irons, channel sections, T-bars, window profiles, trackways for lifts or elevators or the like, in cooperation with a straightening operation, such sections being different from rolled bars having a plain profile such as round and flat bars, etc.

In the description hereinafter we shall call the bars with a plain profile "rolled bars", whereas sections with a complex profile will be called "rolled sections".

Plants for straightening and cutting to size rolled sections and bars such as angle irons, channel sections, T-bars, window profiles, trackways for lifts or elevators and the like are known (see EP-A-No. 0,067,391). Such plants provide a straightening machine and, downstream thereof, a flying shears able to shear layers of rolled stock to size while moving.

However, these plants involve great problems in shearing rolled sections and therefore it is often referred to avoid shearing such sections to size in cooperation with the straightening operation.

These problems arise due to the fact that while rolled bars may be cut by means of normal (flying) shears, in the case of rolled sections, which have a relatively more complex profile, the use of special shears, specific to each kind of profile is required, in order to avoid the ends of the rolled sections to present deformations or burrs.

These problems become even worse when it is necessary to operate on layers of rolled sections, that is to say, when several rolled sections have to be straightened at one and the same time, as is required in the modern rolling art.

A plant according to such rolling art can be seen in document EP-A-No. 0,201,120, which discloses a procedure and a device to feed a multiple-feed straightening machine automatically downstream of a cooling plate.

This document does not mention the problems arising during the cutting operation of the rolled sections and may be only seen as a state of the art example in the field of rolling.

Document DE-C-No. 1,217,747 discloses a rolled conveyor feeding a straightening machine positioned on line with said conveyor, which is located aside of a cooling plate and cooperates therewith. A layer of rolled sections is moved from the cooling plate to the conveyor, where it is firstly clamped at one end, secondly clamped at the other end by means of jaws configured with the same shape of the rolled sections.

While the rolled sections are clamped, their ends are cropped by means of appropriate saws.

The layer of rolled sections passes then through the straightening machine, after which the rolled sections are distributed on two separate cutting conveyors, on which they are cut by means of shears.

Document EP-A-No. 0,067,391 discloses a development of the plant described in DE-C-No. 1,217,747, in that it provides a single flying shears.

In both cases the procedure is slow and complicated, especially in the case of DE-C-No. 1,217,747 where special clamping jaws are required, which must have the same shape as the rolled section. Some kinds of rolled sections, having a relatively complex profile, as T-bars, window profiles, or trackways for elevators, may not be correctly clamped.

SUMMARY OF THE INVENTION

In order to obviate the problems and the drawbacks of the prior art and to be able to straighten and shear to size layers of rolled sections such as angle irons, channel sections, T-bars, trackways for lifts or elevators and the like the present application has developed a plant having the features disclosed in claim 1.

According to the invention a disk saw to shear rolled sections, such as angle irons, channel sections, T-bars, trackways for lifts or elevators and the like, is introduced into a straightening and mechanical cutting line which is suitable to straighten layers of rolled bars, such as round and flat bars, and to cut them to size while they are in movement.

In this way the following advantages are obtained:

(a) avoiding the use of two different straightening and cutting lines for, respectively, rolled bars and rolled sections;

(b) avoiding the use of special shears or clamping jaws.

According to the invention the disk saw can be located upstream or downstream of the straightening machine.

Moreover, according to the invention the disk saw cooperates with a facing and stopping station.

According to another form of embodiment the disk saw cooperates with an assemblage of draw rolls, which are positioned upstream and cooperate with means that measure the length of the sections and stop them.

When the pre-set length is reached, the disk saw shears the rolled sections and then retreats and the rolled sections restart their forward movement.

Clamping rolls or clamps may be provided to cooperate with the rolled sections immediately upstream and immediately downstream of the operating position of the disk saw.

DETAILED DESCRIPTION OF THE PREFERRED EMBODIMENTS

Figure 1:
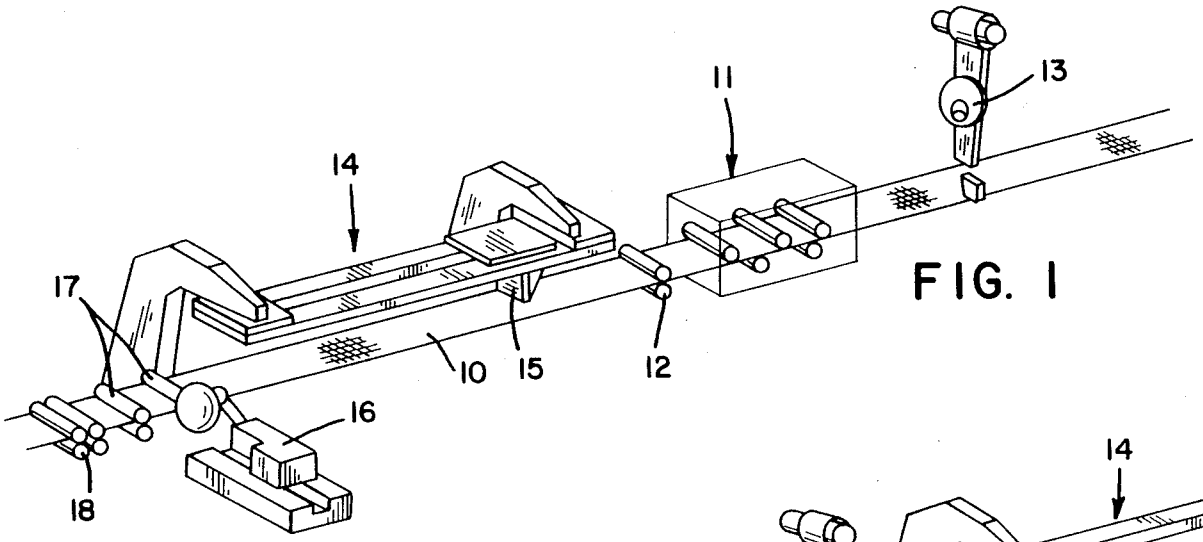
FIG. 1 is a schematic perspective view of a first embodiment of the invention.

In the figures a line 10 to feed rolled stock comprises a straightening machine 11 with intake draw rolls 12 and a flying shears 13, which must be suitable to shear a layer of rolled bars while they are moving; the rolled bars are positioned side by side for the straightening of a layer of bars and not of one single rolled bar, this system being known from EP-A-No. 0,201,120.

The feed line 10 is fed in a known manner from a cooling plate 19.

Known means, which are not shown here but form a layer of rolled bars or rolled sections positioned side by side, are included on and in cooperation with the feed line 10.

According to the invention a disk saw 16 for cutting the rolled sections is provided in cooperation with a straightening machine 11.

Figure 2:
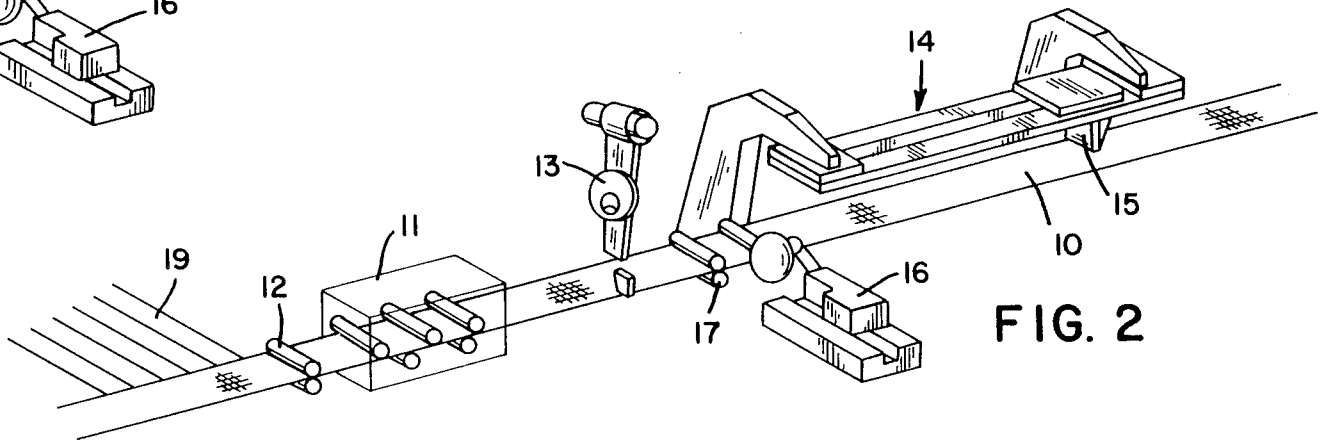
FIG. 2 is a schematic perspective view of a second embodiment of the invention.

This disk saw 16 may be located upstream (FIG. 1) or downstream (FIG. 2) of the straightening machine 11. When the disk saw 16 is working, the flying shears 13 is not working and viceversa.

The disk saw 16 comprises advantageously, immediately upstream and downstream of itself, means 17 to stop and clamp a layer of rolled sections.

A device 14 to perform butting and measurement of sections and comprising a movable carriage 15 to adapt the cutting length cooperates with the disk saw 16.

When the layer of rolled sections abuts against the movable carriage 15, it stops momentarily; the disk saw 16 advances, cuts the sections and then withdraws; the movable carriage 15 is retracted and the layer of rolled sections re-starts its forward movement.

A device 18 including draw rolls and able to measure the length of the layer of rolled sections and to stop them when the required length is reached may be provided instead of the device 14 that butts and measures the rolled sections.

This device 18 with draw rolls may be incorporated in the straightening machine 11 if the disk saw 16 is positioned downstream of the straightening machine.

According to the invention the layer of particular rolled sections cited earlier is positioned lengthwise along the feed line 10, is stopped momentarily and is then cut to size.

The words "disk saw" shall be understood here as including the whole range of saws and cutting-off machines having a circular or, at any rate, rotary tool.

I claim:

1. A plant for cutting to size rolled sections including angle irons, channel sections, T-bars, window profiles and trackways for lifts or elevators, and rolled bars including round bars and flat bars, comprising: a cooling plate; a feed line for receiving the rolled sections or bars from the cooling plate; a disk saw for cutting to size the rolled sections on the feed line; located upstream of the disk saw along said feed line for drawing and measuring the rolled sections in cooperation with the disk saw; means located downstream of the disk saw along the feed line, for butting and measuring different lengths of the rolled sections in cooperation with the disk saw; a straightening machine located downstream of the butting and measuring means, for straightening the rolled sections or bars on the feed line; and, a shears located downstream of the straightening machine, for cutting the rolled bars to size on the feed line while they are moving.

2. The plant as claimed in claim 1, further comprising clamping means located adjacent to the disk saw along said feed line for clamping the rolled sections while they are cut by the disk saw.

3. The plant as claimed in claim 1, wherein said means for butting and measuring comprises a movable carriage for abutting the rolled sections on said feed line so as to stop the rolled sections while they are cut by said disk saw.

* * * * *